US010208267B2

(12) United States Patent
Basu et al.

(10) Patent No.: US 10,208,267 B2
(45) Date of Patent: Feb. 19, 2019

(54) INDUSTRIAL GEAR LUBRICANT ADDITIVE PACKAGE WITH BIODEGRADABLE SULFUR COMPONENT

(71) Applicant: The Lubrizol Corporation, Wickliffe, OH (US)

(72) Inventors: Shubhamita Basu, Willoughby, OH (US); James N. Vinci, Mayfield Heights, OH (US); Michael S. Wragg, Bramcote (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/501,358

(22) PCT Filed: Aug. 6, 2015

(86) PCT No.: PCT/US2015/043970
§ 371 (c)(1),
(2) Date: Feb. 2, 2017

(87) PCT Pub. No.: WO2016/022773
PCT Pub. Date: Feb. 11, 2016

(65) Prior Publication Data

US 2017/0218294 A1 Aug. 3, 2017

Related U.S. Application Data

(60) Provisional application No. 62/033,784, filed on Aug. 6, 2014.

(51) Int. Cl.
*C10M 135/04* (2006.01)
*C10M 135/02* (2006.01)
*C10M 135/06* (2006.01)

(52) U.S. Cl.
CPC ..... *C10M 135/04* (2013.01); *C10M 135/02* (2013.01); *C10M 135/06* (2013.01); *C10M 2203/003* (2013.01); *C10M 2203/024* (2013.01); *C10M 2219/022* (2013.01); *C10M 2219/024* (2013.01); *C10N 2220/025* (2013.01); *C10N 2220/10* (2013.01); *C10N 2230/06* (2013.01); *C10N 2230/64* (2013.01); *C10N 2240/04* (2013.01)

(58) Field of Classification Search
CPC ..... C10M 2219/022; C10N 2220/10
See application file for complete search history.

(56) References Cited

U.S. PATENT DOCUMENTS 5,282,989 A * 2/1994 Erickson ..... C10M 135/06 508/337
5,700,764 A * 12/1997 Walters ..... C10M 141/10 508/338
5,703,022 A * 12/1997 Floyd ..... C10M 169/04 508/345
5,880,075 A * 3/1999 Hartley ..... C10M 169/04 44/389
6,884,855 B2 * 4/2005 Nelson ..... C10M 135/04 525/535
7,648,948 B2 * 1/2010 Wu ..... C10M 141/10 508/279
9,133,414 B2 * 9/2015 Bouffet ..... C10M 169/04
2006/0148663 A1 * 7/2006 Shimizu ..... C10L 1/2418 508/465
2008/0274921 A1 * 11/2008 MacPherson ..... C10M 161/00 508/287
2009/0176670 A1 * 7/2009 Kawasaki ..... C10M 169/04 508/177
2015/0045270 A1 * 2/2015 Bastien ..... C10M 141/08 508/364
2016/0097016 A1 * 4/2016 Iba ..... C07C 321/14 508/570
2016/0122678 A1 * 5/2016 Akucewich ..... C10M 137/02 508/436
2016/0122683 A1 * 5/2016 Basu ..... C10M 141/10 508/434
2016/0215231 A1 * 7/2016 Iba ..... C07C 319/22

* cited by examiner

*Primary Examiner* — Ellen M McAvoy
(74) *Attorney, Agent, or Firm* — Christopher P. Demas; Teresan W. Gilbert

(57) ABSTRACT

The present technology includes an extreme pressure additive package formulated with a biodegradable sulfur component, which additive package can achieve suitable extreme pressure performance when formulated into a fully formulated industrial gear oil lubricant.

9 Claims, No Drawings

INDUSTRIAL GEAR LUBRICANT ADDITIVE PACKAGE WITH BIODEGRADABLE SULFUR COMPONENT

BACKGROUND OF THE INVENTION

The present technology includes an extreme pressure additive package formulated with a biodegradable sulfur component, which additive package can achieve suitable extreme pressure performance when formulated into a fully formulated industrial gear oil lubricant.

Industrial gearboxes see extreme operating conditions that can lead to damage, for example, wear to the internal components of the gearbox. This damage reduces the life of the industrial gearbox and can lead to costly and prolonged maintenance, repair costs, unscheduled downtime for the equipment that contains the industrial gearbox, and similar problems.

There is an on-going need for improved industrial gearbox lubricants that can provide better performance in and protection of industrial gearboxes, thus extending the service life of the industrial gearboxes and the equipment that contains them.

One means of protecting an industrial gearbox is to lubricate the gearbox with a lubricant having sulfur containing compounds. The sulfur in the sulfur containing compounds can react with the metal surfaces of gears to provide a thin protective layer over the metal surface that is resistant to extreme pressures and metalon-metal wear. Such sulfur containing extreme pressure agents used in industrial gear oils are not biodegradeable. It would be desirable to reduce or eliminate the need for such non-biodegradeable compounds from lubricating compositions.

Because of the importance of sulfur in providing protection against extreme pressures and wear, there has not been a viable solution to the reduction or elimination of such non-biodegradable sulfur-containing compounds.

There is a need for an industrial gear lubricant that can provide suitable gearbox protection with minimal amounts of non-biodegradable components.

SUMMARY OF THE INVENTION

It has now been found that suitable gearbox protection can be provided, as measured by Timken (ASTM D2782), by employing a biodegradable sulfurized olefin, such as, for example, a sulfurized vegetable oil. The biodegradable sulfurized olefin can be employed on its own or with a traditional non-biodegradable sulfurized olefin. In fact, it has been found that the load bearing properties of sulfurized components can be maximized, thus limiting treat levels, by differentiating the chemical composition of the sulfurized components; for example, by adding a second or third sulfurized compound of different chemical structure.

Thus, the disclosed technology provides an industrial gear lubricant additive package, an industrial gear lubricant concentrate, and/or a fully formulated industrial gear lubricant (industrial gear lubricant for short) containing a biodegradable sulfurized olefin, and that can meet the performance standards for an industrial gear lubricant.

In one embodiment, there is provided an additive package for industrial gear lubricants. The additive package can comprise at least one sulfurized olefin. The sulfurized olefin can include at least one biodegradable sulfurized olefin.

The at least one biodegradable sulfurized olefin can have varying levels of sulfur activity. In one embodiment, the at least one biodegradable sulfurized olefin can include at least one minimally active biodegradable sulfurized olefin as measured under ASTM D1662 at 150° C. In the same or an alternate embodiment, the at least one biodegradable sulfurized olefin can include a nominally active biodegradable sulfurized olefin as measured under ASTM D1662 at 150° C.

In an embodiment, the at least one biodegradable sulfurized olefin includes at least one biodegradable sulfurized olefin derived from a natural source, such as animal or vegetable source. In one embodiment, the at least one biodegradable sulfurized olefin derived from a natural source can include at least one biodegradable sulfurized olefin derived from rapeseed oil.

In some embodiments, the at least one sulfurized olefin can further include at least one non-biodegradable sulfurized olefin in addition to the biodegradable sulfurized olefin. In such embodiments, the at least one biodegradable sulfurized olefin will be a major portion of the at least one sulfurized olefin.

In some embodiments, the at least one non-biodegradable sulfurized olefin can include at least one non-biodegradable sulfurized olefin derived from at least one of di-isobutylene, butylene, isobutylene, or mixtures thereof. In an embodiment, the at least one non-biodegradable sulfurized olefin can include at least one nominally active non-biodegradable sulfurized olefin as measured under ASTM D1662 at 150° C. In the same or an alternate embodiment, the at least one non-biodegradable sulfurized olefin can include a highly active non-biodegradable sulfurized olefin as measured under ASTM D1662 at 150° C.

In addition to sulfurized olefins, the additive package can also have further additive components, such as, for example, anti-wear components, corrosion components, anti-foam additive components, demulsifiers, and other additive components suitable for industrial gear lubricants.

In an embodiment, there is provided an industrial gear oil lubricant containing the additive package as described above, along with a major amount of an oil of lubricating viscosity.

In embodiments, the oil of lubricating viscosity in the industrial gear oil lubricant can be at least one of synthetic oils, vegetable oils, mineral oils, or mixtures thereof.

In such industrial gear oil lubricants, the additive package can be included such that the additive package delivers less than 0.10 wt %, based on the total weight of the industrial gear oil lubricant of a non-biodegradable sulfurized olefin derived from di-isobutylene. Similarly, in such industrial gear oil lubricants, the additive package can be included such that the additive package delivers less than 0.25 wt %, based on the total weight of the industrial gear oil lubricant, of a non-biodegradable sulfurized olefin derived from isobutylene.

In an embodiment of the industrial gear oil lubricant, the major amount of an oil of lubricating viscosity can be a biodegradable synthetic oil, such as, for example, a biodegradable saturated synthetic oil.

In an embodiment, the sulfurized olefin in the additive package can deliver greater than about 0.80 wt % active sulfur to the industrial gear oil lubricant as measured at 150° C. under ASTM D1662.

In a further embodiment, the sulfurized olefin in the additive package can deliver to the industrial gear oil lubricant from about 0.50 to about 20 wt % of at least one biodegradable sulfurized olefin.

In a still further embodiment, the additive package can deliver to the industrial gear oil lubricant, in addition to the biodegradable sulfurized olefin, from about 0.01 to about 1 wt % of at least one non-biodegradable sulfurized olefin.

There is also provided a method of operating an industrial gear comprising applying to the industrial gear an industrial gear oil as described above, and operating the industrial gear.

DETAILED DESCRIPTION OF THE INVENTION

Various preferred features and embodiments will be described below by way of non-limiting illustration.

The present technology relates in part to an additive package for industrial gear lubricants containing at least one biodegradable sulfurized olefin. The technology can further include an additive package for industrial gear lubricants comprising, consisting essentially of, or consisting of (a) at least one biodegradable sulfurized olefin, and (b) at least one non-biodegradable sulfurized olefin.

Sulfurized olefins are well known commercial materials prepared by reacting a single reactant or a mixture of appropriate reactants with a source of sulfur. The sulfurization reaction generally is effected at an elevated temperature, e.g., 50-350° C. or 100-200° C., with efficient agitation and often in an inert atmosphere such as nitrogen, optionally in the presence of an inert solvent. The sulfurizing agents can include elemental sulfur, which is preferred, hydrogen sulfide, sulfur halide, sodium sulfide and a mixture of hydrogen sulfide and sulfur or sulfur dioxide. Usually, the amount of sulfur or sulfurizing agent employed is calculated based on the total olefinic unsaturation of the mixture. Typically 0.5 to 3 moles of sulfur are employed per mole of olefinic bonds. One type of sulfurized olefin can be prepared in accordance with the detailed teachings of U.S. Pat. No. 4,957,651.

In the case of sulfurized olefins, the reactant can be an olefinic compound. Olefinic compounds which may be sulfurized are diverse in nature, and broadly speaking are those that contain at least one olefinic double bond, which is defined as a non-aromatic double bond; that is, a double bond connecting two aliphatic carbon atoms. In its broadest sense, the olefin may be defined by the formula $R^1R^2C{=}CR^3R^4$, wherein each of $R^1$, $R^2$, $R^3$ and $R^4$ can be hydrogen or an organic group. In general, the R groups in the above formula which are not hydrogen may be satisfied by such groups as $—C(R^5)_3$, $—COOR^5$, —COOM, —X, $—YR^5$ or —Ar, wherein each $R^5$ is independently hydrogen, alkyl, alkenyl, aryl, substituted alkyl, substituted alkenyl or substituted aryl, with the proviso that any two $R^5$ groups can be alkylene or substituted alkylene whereby a ring of up to 12 carbon atoms is formed; M is one equivalent of a metal cation (preferably Group I or II, e.g., sodium, potassium, barium, calcium); X is halogen (e.g., chloro, bromo, or iodo); Y is oxygen or divalent sulfur; Ar is an aryl or substituted aryl group of up to 12 carbon atoms. Any two of $R^1$, $R^2$, $R^3$ and $R^4$ may also together form an alkylene or substituted alkylene group; i.e., the olefinic compound may be alicyclic.

The olefinic compound is usually one in which each R group, above, which is not hydrogen is independently alkyl, alkenyl or aryl group. Monoolefinic and diolefinic compounds, particularly the former, are preferred, and especially terminal monoolefinic hydrocarbons; that is, those compounds in which $R^3$ and $R^4$ are hydrogen and $R^1$ and $R^2$ are alkyl or aryl, especially alkyl (that is, the olefin is aliphatic) having 1 to 30, or 1 to 16, or 1 to 8, or 1 to 4 carbon atoms. Olefinic compounds having 3 to 30 or 3 to 16 (often fewer than 9) carbon atoms can be used.

Isobutene, di-isobutylene, butylene, propylene and their dimers, trimers and tetramers, and mixtures thereof are useful as olefinic compounds for sulfurization, as are terpene compounds, that is, various isomeric terpene hydrocarbons having the empirical formula $C_{10}H_{16}$, as well as various synthetic and naturally occurring oxygen-containing derivatives thereof.

Other sulfurized olefins include those derived from natural sources, such as sulfurized vegetable oils and sulfurized lard oil (that is, sulfurized oils of animal sources generally). Example of natural oils from which such sulfurized olefins may be derived can include, but not be limited to, coconut oil, corn oil, cottonseed oil, castor oil, sunflower oil, olive oil, palm oil, peanut oil, rapeseed oil, safflower oil, sesame oil, soybean oil, tallow, lard, fatty acids, and mixtures thereof. Preferred organic portions for the sulfurized vegetable oil are those derived from sunflower oil, olive oil, and rapeseed oil.

It often is the case that the naturally derived sulfurized olefins are biodegradable and the synthetically derived sulfurized olefins, such as, for example, those that are derived from isobutylene, di-isobutylene, and butylene, are non-biodegradable. However, some biodegradable sulfurized olefins can contain a portion of synthetically derived olefin and a portion of naturally derived olefin, and vice versa. While the foregoing classification is not conclusive, it can provide an initial screening for the selection of a biodegradable or non-biodegradable sulfurized olefin. Alternatively, or in addition, the biodegradability of the sulfurized olefin can be determined empirically according to standardized testing methods. For example, the Organization for Economic Cooperation and Development (OECD) has developed several test methods for testing the level of biodegradability of a material, including, for example, OECD 301B. If a material passes OECD 301B with greater than 60% biodegradation in 28 days, it is considered readily biodegradable. If a material passes OECD 301B with biodegradation of about 20 to about 60% in 28 days, it is considered inherently biodegradable. Below 20% biodegradation in 28 days is considered non-biodegradable. Biodegradable as used herein refers to materials that are either readily biodegradable or inherently biodegradable according to OECD 301B.

In one embodiment, the sulfur component of the additive package of the present technology can comprise, consists of, or consist essentially of a biodegradable sulfurized olefin derived from a natural source. In one embodiment, the sulfur component can be a biodegradable sulfurized vegetable oil. In one embodiment, the sulfur component can be biodegradable sulfurized lard. In one embodiment the sulfur component of the additive package consists of biodegradable sulfurized olefin.

In an embodiment, the sulfur component of the additive package comprises, consists of, or consists essentially of (a) a major portion of a biodegradable sulfurized olefin derived from a natural source (sulfurized vegetable oil, sulfurized lard, or a mixture thereof), and (b) a minor portion of a non-biodegradable sulfurized olefin derived from di-isobutylene, isobutylene, butylene, or a mixture thereof. For example, in an embodiment, the sulfur component of the additive package comprises, consists of, or consists essentially of (a) a major portion of a biodegradable sulfurized vegetable oil, and (b) a minor portion of a non-biodegradable sulfurized olefin derived from di-isobutylene. In another embodiment, the sulfur component of the additive package comprises, consists of, or consists essentially of (a) a major portion of a biodegradable sulfurized vegetable oil, and (b) a minor portion of a non-biodegradable sulfurized olefin derived from isobutylene. In an even further embodiment, the sulfur component of the additive package comprises, consists of, or consists essentially of (a) a major portion of a biodegradable sulfurized vegetable oil, and (b) a minor portion of a non-biodegradable sulfurized olefin derived from butylene. The technology additionally includes the foregoing embodiments but with biodegradable sulfurized lard. Further similar embodiments are envisioned with a mixture of biodegradable sulfurized vegetable oil and biodegradable sulfurized lard.

By "major portion," it is meant 50 wt % or greater, such as, for example, from 50.1 to 99.99 wt %, or 60 to 95 wt %, or even 70 or 80 to 90 wt %. Conversely, a "minor portion" can be 50 wt % or less, such as, for example, 0.01 to about 49.9 wt %, or 5 to 40 wt %, or even 10 to 20 or 30 wt %.

In one aspect, the sulfurized olefins can additionally be classified according to the level of active sulfur present therein, and/or the total level of sulfur present therein. By "active" it is meant the amount of sulfur available for a reaction at a certain temperature. The mole percent of active sulfurs in a sulfur containing compound is determined empirically according to ASTM D1662. Whether biodegradable or non-biodegradable, the sulfurized olefins can be "highly active," "nominally active," or "minimally active," depending on the temperature at which activity is determined. As measured at 150° C. according to D1662, "highly active" sulfurized olefin refers to a sulfurized olefin having about 66 wt % or more of the sulfurs contained therein as active sulfurs, i.e., available to react with the metal surface. Likewise, as measured at 150° C. according to D1662, "nominally active" sulfurized olefin refers to sulfurized olefins having from about 33 wt % to about 66 wt % of the sulfurs contained therein as active sulfurs, and "minimally active" sulfurized olefin refers to a sulfurized olefin having less than about 33 wt %, or from about 0.1 to about 33 wt % of the sulfurs contained therein as active sulfurs. Alternatively, when measured at 100° C. under the D1662 method, "highly active" sulfurized olefin refers to a sulfurized olefin having about 20 wt % or more of the sulfurs contained therein as active sulfurs, "nominally active" sulfurized olefin refers to sulfurized olefins having from about 10 wt % to about 20 wt % of the sulfurs contained therein as active sulfurs, and "minimally active" sulfurized olefin refers to a sulfurized olefin having less than about 10 wt %, or from about 0.01 to about 10 wt % of the sulfurs contained therein as active sulfurs.

In an embodiment, the sulfurized olefin of the additive package comprises, consists essentially of, or consists of at least one of a highly active biodegradable sulfurized olefin, nominally active biodegradable sulfurized olefin, minimally active biodegradable sulfurized olefin, and/or mixture thereof, as measured at 150° C. under the D1662. In an embodiment, the sulfurized olefin of the additive package comprises, consists essentially of, or consists of at least one of a highly active biodegradable sulfurized olefin, nominally active biodegradable sulfurized olefin, minimally active biodegradable sulfurized olefin, and/or mixture thereof, as measured at 100° C. under the D1662.

The total level of sulfur in the sulfurized olefin can be measured according to ASTM D129Q. Whether biodegradable or non-biodegradable, the sulfurized olefins can have a "high," "nominal," or "minimal," level of total sulfur. A "high" level of sulfur means the sulfurized olefin contains about 30 wt % or greater sulfur. A "nominal" level of sulfur means the sulfurized olefin contains from about 10 to about 30 wt % sulfur, and a "minimal" level of sulfur means the sulfurized olefin contains less than about 10 wt % sulfur, or from about 0.01 to about 10 wt % sulfur.

In an embodiment, the sulfurized olefin of the additive package comprises, consists essentially of, or consists of, at least one biodegradable sulfurized olefin having a high level of total sulfur, biodegradable sulfurized olefin having a nominal level of total sulfur, biodegradable sulfurized olefin having a minimal level of total sulfur, and/or mixtures thereof.

In an embodiment, the sulfur component of the additive package can comprise, consist essentially of, or consist of at least one highly active sulfurized olefin, nominally active sulfurized olefin, nominally active biodegradable sulfurized olefin, and/or mixture thereof, wherein activity is measured at 150° C. under D1662. In an embodiment, the sulfur component of the additive package can comprise, consist essentially of, or consist of at least one highly active sulfurized olefin, minimally active sulfurized olefin, minimally active biodegradable sulfurized olefin, and/or mixture thereof, wherein activity is measured at 100° C. under D1662.

The amount of biodegradable sulfurized olefin in a fully formulated lubricant will be an amount sufficient to improve the extreme pressure performance of the lubricant, as measured by any well-known wear tests, as described below.

Typically, the biodegradable sulfurized olefin can be included in the fully formulated lubricant at a level of about 0.5 to about 20 wt %, or from about 0.75 to about 15 wt %, or even from about 1 to about 6, or 8, or 10 wt %. In some embodiments, the biodegradable sulfurized olefin can be employed in an amount sufficient to deliver a total active sulfur level in the fully formulated lubricant, on its own or in combination with a non-biodegradable sulfurized olefin, of greater than about 0.80 wt %, or greater than 0.85 wt %, or even greater than 0.90 wt %, such as, for example, from about 0.80 to about 3 wt %, or about 0.85 to about 2 wt %, or about 0.90 to about 1 or 1.5 wt %, as measured at 150° C. under ASTM D1662.

When present in a fully formulated lubricant, the non-biodegradable sulfurized olefin can be so at less than 1 wt %, or less than 0.25 wt %, or less than 0.1 wt %. In some embodiments, the non-biodegradable sulfurized olefin can be present in the fully formulated lubricant at from about 0.01 to about 1 wt %, or 0.10 to 0.80 wt % or 0.15 to 0.70 wt % or 0.20 to 0.60 wt %. In some embodiments, the non-biodegradable sulfurized olefin can be employed in an amount sufficient to achieve a total active sulfur level in the fully formulated lubricant, in combination with at least one biodegradable sulfurized olefin, of greater than about 0.80 wt %, or greater than 0.85 wt %, or even greater than 0.90 wt %, such as, for example, from about 0.80 to about 3 wt %, or about 0.85 to about 2 wt %, or about 0.90 to about 1 or 1.5 wt %, as measured at 150° C. under ASTM D1662.

The industrial gear lubricant can contain further additive components suitable for industrial gear lubricants. Any combination of conventional additive components suitable for use in industrial gear applications may be used.

The further additive components which may be present in the industrial gear additive package in addition to the sulfurized olefins described above include, but are not limited to, foam inhibitors, demulsifiers, pour point depressants, antioxidants, dispersants, metal deactivators (such as copper deactivators), phosphorus containing antiwear agents, viscosity modifiers, or some mixture thereof. The non-sulfurized additive components may each be present in the range from 50, 75, 100 or even 150 ppm up to 5, 4, 3, 2 or even 1.5 wt %, or from 75 ppm to 0.5 wt %, from 100 ppm to 0.4 wt %, or from 150 ppm to 0.3 wt %, where the wt % values are with regards to an individual component in respect of a fully formulated industrial gear lubricant. However it is noted that some additives, including viscosity modifying polymers, which may alternatively be considered as part of the oil of lubricating viscosity, may be present in higher amounts including up to 30, 40, or even 50% by weight when considered separate from the oil of lubricating viscosity. The additives may be used alone or as mixtures thereof.

Phosphorus containing antiwear and/or extreme pressure agents that are typically used in industrial gear lubricants are for the most part partially or fully esterified acids of phosphorus. All of these are suitable for the industrial gear lubricant additive packages herein. Such antiwear agents include, but are not limited to, acid phosphates, hydrogen phosphites, phosphites, phosphates, phosphonates, phosphinates, and phosphoroamidates. Further antiwear agents can also include mono, di and trihydrocarbyl phosphites; mono, di, and trihydrocarbyl phosphates; mono, di, and trihydrocarbyl mono, di, tri, tetrathiophosphates; mono, di, trihydrocarbyl mono, di, tri, tetrathiophosphites; various hydrocarbyl phosphonates and thiophosphonates; various hydrocarbyl phosphonites and thiophosphonites, and the like.

Examples of phosphites include mono-hydrocarbyl substituted phosphite, a di-hydrocarbyl substituted phosphite, or a tri-hydrocarbyl substituted phosphite, and those phosphites having at least one hydrocarbyl group with 4 or more carbon atoms as represented by the formulae:

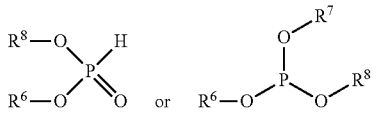

wherein at least one of $R^8$, $R^6$ and $R^7$ may be a hydrocarbyl group containing at least 4 carbon atoms and the other may be hydrogen or a hydrocarbyl group. In one embodiment $R^8$, $R^6$ and $R^7$ are all hydrocarbyl groups. The hydrocarbyl groups may be alkyl, cycloalkyl, aryl, acyclic or mixtures thereof. In the formula with all three groups $R^8$, $R^6$ and $R^7$, the compound may be a tri-hydrocarbyl substituted phosphite i.e., $R^8$, $R^6$ and $R^7$ are all hydrocarbyl groups. Alkyl groups may be linear or branched, typically linear, and saturated or unsaturated, typically saturated. Examples of alkyl groups for $R^8$, $R^6$ and $R^7$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof.

All of the amine salts that can be formed with the above-mentioned phosphorus containing antiwear agents are included. The amines can be primary, secondary, tertiary, acyclic or cyclic, mono or polyamines. They can also be heterocyclic. The preferred amines are generally aliphatic in nature. Some specific examples of amines for producing amine salts of the phosphorus containing antiwear agents include: octylamine, decylamine, C10, C12, C14 and C16 tertiary alkyl primary amines (or combinations thereof), laurylamine, hexadecylamine, heptadecylamine, octadecylamine, decenylamine, dodecenylamine, palmitoylamine, oleylamine, linoleylamine, di-isoamylamine, di-octylamine, di-(2-ethylhexyl)amine, dilaurylamine, cyclohexylamine, 1,2-propylene amine, 1,3-propylenediamine, diethylene triamine, triethylene tetraamine, ethanolamine, triethanolamine, trioctylamine, pyridine, morpholine, 2-methylpiperazine, 1,2-bis(N-piperazinyl-ethane), 1,2-diamine, tetraminooctadecene, triaminooctadecene, N-hexylaniline and the like. The amines may also be triazole or triazole derivatives.

In an embodiment, an amine salt of the phosphorus containing antiwear agent are those of the formula:

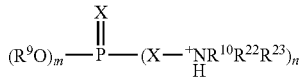

where $R^9$ and $R^{10}$ are independently aliphatic groups containing from about 4 up to about 24 carbon atoms, $R^{22}$ and $R^{23}$ are independently hydrogen or aliphatic groups containing from about 1 up to about 18 aliphatic carbon atoms, the sum of m and n is 3 and X is oxygen or sulfur. In a preferred embodiment, $R^9$ contains from about 8 up to 18 carbon atoms, $R^{10}$ is:

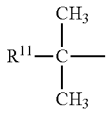

wherein $R^{11}$ is an aliphatic group containing from about 6 up to about 12 carbon atoms, $R^{22}$ and $R^{23}$ are hydrogen, m is 2, n is 1 and X is oxygen.

Specific examples of phosphorus containing antiwear agents can include tricresyl phosphate, tributylphosphite, triphenyl phosphite, 2-ethylhexyl phosphate, diisobutylhydrogen phosphite, diisopropyl dithiophosphate, diphenyl phosphate, fatty phosphites, etc. Some embodiments of phosphorus containing antiwear agents can include the dialkyl and diaryl phosphates and their amine salts. Also considered are aryl phosphates, such as the commercially available Irgalube™ 349 from Ciba and alkyl acid phosphates, including di- and/or mono-2-ethylhexyl phosphoric acid.

Antifoams, also known as foam inhibitors, are known in the art and include but are not limited to organic silicones and non-silicon foam inhibitors. Examples of organic silicones include dimethyl silicone and polysiloxanes. Examples of non-silicon foam inhibitors include but are not limited to polyethers, polyacrylates and mixtures thereof as well as copolymers of ethyl acrylate, 2-ethylhexylacrylate, and optionally vinyl acetate. In some embodiments the antifoam is a polyacrylate. Antifoams may be present in the composition from 0.001 to 0.012 or 0.004 wt % or even 0.001 to 0.003 wt %.

Demulsifiers are known in the art and include but are not limited to derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers are polyethers. Demulsifiers may be present in the composition from 0.002 to 0.2 wt %.

Pour point depressants are known in the art and include but are not limited to esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The compositions of the present technology may also include a rust inhibitor. Suitable rust inhibitors include hydrocarbyl amine salts of dialkyldithiophosphoric acid, hydrocarbyl amine salts of hydrocarbyl arenesulphonic acid and fatty carboxylic acids or esters thereof, an ester of a nitrogen-containing carboxylic acid, an ammonium sulfonate, an imidazoline, mono-thio phosphate salts or esters, or any combination thereof; or mixtures thereof.

Examples of hydrocarbyl amine salts of dialkyldithiophosphoric acid of the technology include but are not limited to the reaction product(s) of diheptyl or dioctyl or dinonyl dithiophosphoric acids with ethylenediamine, morpholine or Primene™ 81R or mixtures thereof.

Suitable hydrocarbyl amine salts of hydrocarbyl arenesulphonic acids used in the rust inhibitor package of the technology are represented by the formula:

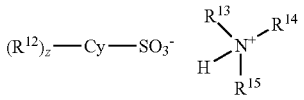

(V)

wherein Cy is a benzene or naphthalene ring. $R^{12}$ is a hydrocarbyl group with about 4 to about 30, preferably about 6 to about 25, more preferably about 8 to about 20 carbon atoms. z is independently 1, 2, 3, or 4 and most preferably z is 1 or 2. $R^{15}$, $R^{13}$ and $R^{14}$ are the same as described above. Examples of hydrocarbyl amine salts of hydrocarbyl arenesulphonic acid of the technology include but are not limited to the ethylenediamine salt of dinonylnaphthalene sulfonic acid. Examples of suitable fatty carboxylic acids or esters thereof include glycerol monooleate and oleic acid.

An example of a suitable ester of a nitrogen-containing carboxylic acid includes oleyl sarcosine. The rust inhibitors may be present in the range from 0.02 to 0.2, from 0.03 to 0.15, from 0.04 to 0.12, or from 0.05 to 0.1 wt % of the industrial gear lubricant. The rust inhibitors of the present technology may be used alone or in mixtures thereof.

The compositions of the present technology may also include a metal deactivator. Metal deactivators are used to neutralise the catalytic effect of metal for promoting oxidation in the industrial gear lubricant. Suitable metal deactivators include but are not limited to triazoles, tolyltriazoles, a thiadiazole, or combinations thereof, as well as derivatives thereof. Examples include derivatives of benzotriazoles, benzimidazole, 2-alkyldithiobenzimidazoles, 2-alkyldithiobenzothiazoles, 2-(N,N'-dialkyldithio-carbamoyl)benzothiazoles, 2,5-bis(alkyl-dithio)-1,3,4-thiadiazoles, 2,5-bis(N,N'-dialkyldithiocarbamoyl)-1,3,4-thiadiazoles, 2-alkyldithio-5-mercapto thiadiazoles or mixtures thereof. These additives may be used from 0.01 to 0.25 wt % in the overall composition. In some embodiments the metal deactivator is a hydrocarbyl substituted benzotriazole compound. The benzotriazole compounds with hydrocarbyl substitutions include at least one of the following ring positions 1- or 2- or 4- or 5- or 6- or 7-benzotriazoles. The hydrocarbyl groups contain about 1 to about 30, preferably about 1 to about 15, more preferably about 1 to about 7 carbon atoms, and most preferably the metal deactivator is 5-methylbenzotriazole used alone or mixtures thereof. The metal deactivators may be present in the range from 0.001 to 0.5, from 0.01 to 0.04 or from 0.015 to 0.03 wt % of the industrial gear lubricant. Metal deactivators may also be present in the composition from 0.002 or 0.004 to 0.02 wt %. The metal deactivator may be used alone or mixtures thereof.

Antioxidants may also be present including (i) an alkylated diphenylamine, and (ii) a substituted hydrocarbyl mono-sulfide. In some embodiments the alkylated diphenylamines of the technology are bis-nonylated diphenylamine and bis-octylated diphenylamine. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol. The antioxidant package may also include sterically hindered phenols. Examples of suitable hydrocarbyl groups for the sterically hindered phenols include but are not limited to 2-ethylhexyl or n-butyl ester, dodecyl or mixtures thereof. Examples of methylene-bridged sterically hindered phenols include but are not limited to 4,4'-methylene-bis(6-tert-butyl o-cresol), 4,4'-methylene-bis(2-tert-amyl-o-cresol), 2,2'-methylene-bis(4-methyl-6-tert-butylphenol), 4,4'-methylene-bis(2,6-di-tertbutylphenol) or mixtures thereof. The antioxidants may be present in the composition from 0.01 wt % to 6.0 wt %, or from 0.02 wt % to 1 wt %. The additive may be present in the composition at 1 wt %, 0.5 wt %, or less.

In some embodiments the industrial gear lubricant additive package of the present technology includes a nitrogen-containing dispersant, for example a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However they may, of course, interact with ambient metals once they are added to a lubricant which includes metal-containing species. Likewise, some derivatives of ashless dispersants may be derivatized and contain ash forming molecules, such as, for example, borated derivatives. Ashless dispersants are characterized by a polar group attached to a relatively high molecular weight hydrocarbon chain. Examples of such materials include succinimide dispersants, Mannich dispersants, and borated derivatives thereof.

In some embodiments the industrial gear additive packages include one or more phosphorous amine salts, but in amounts such that the additive package, or in other embodiments the resulting industrial gear lubricant compositions, contains no more than 1.0 wt % of such materials, or even no more than 0.75 or 0.6 wt %. In other embodiments the industrial gear additive packages, or the resulting industrial gear lubricant compositions, are essentially free of or even completely free of phosphorous amine salts.

In some embodiments the industrial gear lubricant additive package, comprises one or more antiwear additives and/or extreme pressure agents, one or more rust and/or corrosion inhibitors, one or more foam inhibitors, one or more demulsifiers, or any combination thereof.

In some embodiments the industrial gear additive packages, or the resulting industrial gear lubricant compositions, are essentially free of or even completely free of phosphorous amine salts, dispersants, or both.

In one embodiment, the present technology can include a three part mixture of a phosphate amine salt, a phosphate, and a phosphite.

In some embodiments the industrial gear additive packages, or the resulting industrial gear lubricant compositions, include a demulsifier, a corrosion inhibitor, a friction modifier, or combination of two or more thereof. In some embodiments the corrosion inhibitor includes a tolyltriazole. In still other embodiments the industrial gear additive packages, or the resulting industrial gear lubricant compositions, include one or more polysulfides; one or more phosphorus amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

The industrial gear additive package may be present in the overall industrial gear lubricant from 1 to 5 wt %, or in other embodiments from 1, 1.5, or even 2 wt % up to 2, 3, 4, 5, 7 or even 10 wt %. Amounts of the industrial gear additive package that may be present in the industrial gear concentrate compositions of the technology are the corresponding amounts to the weight percent above, where the values are considered without the oil present (i.e. they may be treated as wt % values along with the actual amount of oil present).

The industrial gear lubricant additive package can be admixed with an oil of lubricating viscosity to prepare an industrial gear lubricant that meets or exceeds the standards for environmental friendliness while providing equivalent or improved industrial gear lubricant performance. The oil of lubricating viscosity can be present in a major amount, for a lubricant composition, or in a concentrate forming amount, for a concentrate and/or additive composition. The oil of lubricating viscosity may be biodegradable or non-biodegradable.

Suitable oils include natural and synthetic lubricating oils and mixtures thereof. In a fully formulated lubricant, the oil of lubricating viscosity is generally present in a major amount (i.e. an amount greater than 50 wt %). Typically, the oil of lubricating viscosity is present in an amount of 75 to 98 wt %, and often greater than 80 wt % of the overall composition.

The oil of lubricating viscosity may include natural and synthetic oils, oil derived from hydrocracking, hydrogenation, and hydrofinishing, unrefined, refined and re-refined oils or mixtures thereof. Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and similar processes. Re-refined oils are also known as reclaimed or reprocessed oils, and are obtained by processes similar to those used to obtain refined oils. Re-refined oils are often are processed by techniques directed to removal of spent additives and oil breakdown products.

Natural oils useful as the oil of lubricating viscosity include animal oils and vegetable oils (e.g., castor oil, lard oil), mineral lubricating oils such as liquid petroleum oils and solvent-treated or acid-treated mineral lubricating oils of the paraffinic, naphthenic or mixed paraffinic naphthenic types and oils derived from coal or shale or mixtures thereof.

In an embodiment, the industrial gear lubricant contains a synthetic oil of lubricating viscosity. Synthetic oils may be saturated or unsatureated. Synthetic oils of lubricating viscosity include hydrocarbon oils such as polymerized and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); esters and complex esters from vegetable sourced acids (e.g., diesters, mono esters, saturated polyol esters, trimethyl propane carboxylic esters, neopolyol carboxylic esters, neopentyl glycol esters, pentaerithrytol esters and the like); alkylated biphenyl ethers and alkylated biphenyl sulfides and the derivatives, analogs and homologs thereof or mixtures thereof. In some embodiments the oil of lubricating viscosity used in the invention is a synthetic oil that includes polymerized polyisobutylene, and in some embodiments the oil of lubricating viscosity used in the invention is a synthetic oil that includes polymerized polyisobutylene and a polyalphaolefin.

Another synthetic oil of lubricating viscosity includes polyol esters, dicarboxylic esters, liquid esters of phosphorus-containing acids (e.g., tricresyl phosphate, trioctyl phosphate, and the diethyl ester of decane phosphonic acid), or polymeric tetrahydrofurans. Synthetic conventional oil of lubricating viscosity also includes those produced by Fischer-Tropsch reactions and typically may be hydroisomerised Fischer-Tropsch hydrocarbons or waxes. In one embodiment, the oil of lubricating viscosity may be prepared by a Fischer-Tropsch gas-to-liquid synthetic procedure as well as other gas-to-liquid oils.

Oils of lubricating viscosity may further be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt % and ≥90 wt % saturates, viscosity index 80-120); Group III (sulfur content ≤0.03 wt % and ≥90 wt % saturates, viscosity index ≥120); Group IV (all polyalphaolefins, or PAO, such as PAO-2, PAO-4, PAO-5, PAO-6, PAO-7 or PAO-8); and Group V (which encompasses "all others"). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity includes API Group I, Group II, Group II+, Group III, Group IV, Group V oil or mixtures thereof. In one embodiment, the oil of lubricating viscosity is an API Group I, Group II, Group III, Group IV oil or mixtures thereof. Alternatively, the oil of lubricating viscosity is often an API Group II, Group II+, Group III or Group IV oil or mixtures thereof. Alternatively the oil of lubricating viscosity is often an API Group II, Group II+, Group III oil or mixtures thereof.

In some embodiments the lubricating oil component of the present invention includes a Group II or Group III base oil, or a combination thereof. The oil can also be derived from the hydroisomerization of wax, such as slack wax or a Fischer-Tropsch synthesized wax. Such "Gas-to-Liquid" oils are typically characterized as Group III.

The compositions of the present invention may include some amount of Group I base oils, and even Group IV and Group V base oils. However, in some embodiments the lubricating oil component of the invention contains no more than 20, 10, 5, or even 1 wt % Group I base oil. These limits may also apply to Group IV or Group V base oils. In other embodiments the lubricating oil present in the compositions of the invention is at least 60, 70, 80, 90, or even 98 wt % Group II and/or Group III base oil. In some embodiments the lubricating oil present in the compositions of the invention is essentially only Group II and/or Group III base oil, where small amounts of other types of base oils may be present but not in amounts that significantly impact the properties or performance of the overall composition.

In some embodiments the compositions of the invention include some amount of Group I and/or Group II base oils. In other embodiments the compositions of the invention are lubricating compositions where the oil of lubricating viscosity is primarily Group I and/or Group II base oils, or even essentially Group I and/or Group II base oils, or even exclusively Group I and/or Group II base oils.

In some embodiments the invention provides a Group II composition, that is the oil of lubricating viscosity includes Group II oil, and can even be primarily if not exclusively Group II oil, while still providing synthetic oil composition performance. This is one of the benefits of the present invention.

The various described oils of lubricating viscosity may be used alone or in combinations. The oil of lubricating viscosity may be used in the described industrial gear lubricants in the range of about 80 wt % to about 98 wt %, or from 80, 85, 90, 95, 97 or even 97.5 or 98 wt % oil or up to 90, 95, 97, 97.5, or even 98 wt % oil. The oil of lubricating viscosity may be used as diluent in the described industrial gear additive concentrates in the range of about 1 wt % to about 49 wt %, or from 1, 5, even 10 wt % oil up to 10, 20, 30, 40, or even 45 or 49 wt % oil.

As noted above the technology includes both industrial gear lubricants and industrial gear lubricant additive packages that may be used to make industrial gear lubricants.

In the industrial gear lubricants: the oil of lubricating viscosity, may be present from 80, 85, 90, 95, 97 or even 97.5 or 98 wt % oil up to 90, 95, 97, 97.5, or even 98 wt %; and the industrial gear lubricant additive package, may be present from 1, 1.5, or even 2 wt % up to 2, 3, 4, 5, 7 or even 10 wt %.

In a concentrate of the industrial gear additive: the oil of lubricating viscosity, may be present from 1, 5, even 10 wt % oil up to 10, 20, 30, 40, or even 45 or 49 wt %; and the industrial gear lubricant additive package, may be present from 20, 25, 25.5, 27.5, 30, 35, 45 or even 45 wt % up to 45, 47.5, or even 49.5 wt %.

The industrial gear lubricant of the present technology can meet the performance requirements required of an industrial gear lubricant, as well as standards set for environmental friendliness.

Industrial gear oils (IGOs) must maintain a specified level of performance in the typical bench tests that have been part of well-known industrial gear approvals like USS 224, AGMA 9005-D94, recently replaced by AGMA 9005-E02, DIN 51517-3:2009-06, Fives Cincinnati, etc. With respect to extreme pressure performance, the bench tests include, for example, Four Ball EP (ASTM D2783), Timken (ASTM D2782). Other tests include Four Ball Wear (ASTM D4172), FZG Scuffing (DIN ISO 14635-1), Copper Corrosion Protection (ASTM D130, ISO 2160), Oxidation Control (ASTM D2893, DIN EN ISO 4263-4, S-200), Rust Prevention (ASTM D665, ISO 7120), Static Seal Compatibility (DIN EN ISO 1817), Demulsibility (ASTM D2711, ASTM D1401, ISO 6614), Foam Control (ASTM D892, ISO 6247), etc.

The invention includes methods of making the industrial gear lubricants and/or the industrial gear additive concentrates described above. Such methods include mixing the described components together. No particular order or means of addition is believed to significantly impact the results.

The invention also includes a method adding one of the industrial gear lubricants described herein to an industrial gearbox and then operating that industrial gearbox.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this technology, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0137] to [0141] of published application US 2010-0197536.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present technology in its intended use, may not be susceptible of easy description. Nevertheless, all such modifications and reaction products are included within the scope of the present technology; the present technology encompasses the composition prepared by admixing the components described above.

EXAMPLES

Sample formulations were prepared with varying levels of biodegradable and non-biodegradable sulfurized compounds and tested for extreme pressure performance. The results are provided in Table 1 below.

TABLE 1

| Sample # | Non-Bio 1* wt % | Non-Bio 1* Active S (wt %) | Non-Bio 2** wt % | Non-Bio 2** Active S (wt %) | Bio 1*** wt % | Bio 1*** Active S (wt %) | Bio 2**** wt % | Bio 2**** Active S (wt %) | Tim-ken | Total Active Sulfur (wt %) |
|---|---|---|---|---|---|---|---|---|---|---|
| 1 | 0 | — | 0 | — | 0 | — | 4.9 | 0.700 | 30 | 0.700 |
| 2 | 0 | — | 0.09 | 0.083 | 0 | — | 4.9 | 0.700 | 35 | 0.783 |
| 3 | 0.24 | 0.087 | 0 | — | 0 | — | 4.9 | 0.700 | 30 | 0.787 |
| 4 | 0.24 | 0.087 | 0.09 | 0.083 | 0 | — | 4.9 | 0.700 | 90 | 0.870 |
| 5 | 0 | — | 0 | — | 0 | — | 7.5 | 1.072 | 85 | 1.072 |
| 6 | 0 | — | 0 | — | 0 | — | 10 | 1.429 | 75 | 1.429 |
| 7 | 0.24 | 0.087 | 0.09 | 0.083 | 1.5 | 0.750 | 0 | — | 85 | 0.920 |
| 8 | 0 | — | 0 | — | 1.5 | 0.750 | 0 | — | 40 | 0.750 |
| 9 | 0 | — | 0 | — | 2.5 | 1.251 | 0 | — | 75 | 1.251 |
| 10 | 0.24 | 0.087 | 0 | — | 2.5 | 1.251 | 0 | — | 75 | 1.338 |
| 11 | 0 | — | 0.09 | 0.083 | 2.5 | 1.251 | 0 | — | 85 | 1.334 |
| 12 | 0 | — | 0 | — | 5 | 2.502 | 0 | — | 80 | 2.502 |

*Non-biodegradable sulfurized olefin derived from isobutylene

**Non-biodegradable sulfurized olefin derived from di-isobutylene

***Biodegradable sulfurized olefin derived from vegetable oil - about 17% total sulfur and about 50% active sulfur @ 150° C.

****Biodegradable sulfurized olefin derived from vegetable oil - about 10% total sulfur and about 14% active sulfur @ 150° C.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the technology can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration.

While certain representative embodiments and details have been shown for the purpose of illustrating the subject technology, it will be apparent to those skilled in this art that various changes and modifications can be made therein without departing from the scope of the subject technology. In this regard, the scope of the technology is to be limited only by the following claims.

What is claimed is:

1. An additive package for industrial gear lubricants which meets OECD 301B comprising at least one sulfurized olefin that delivers greater than about 0.80 wt % active sulfur as measured at 150° C in ASTM D1662, wherein the at least one sulfurized olefin comprises from about 0.5 to about 20 wt % of at least one sulfurized olefin that is readily or inherently biodegradable as measured according to OECD301B, and from about 0.01 to about 1 wt % of a non-biodegradable sulfurized olefin comprising at least one of di-isobutylene, butylene, isobutylene, or mixtures thereof, wherein the non-biodegradable sulfurized olefin comprises less than 0.10 wt %, based on the total weight of the industrial gear oil lubricant, of a highly active non-biodegradable sulfurized olefin derived from di-isobutylene and less than 0.25 wt %, based on the total weight of the industrial gear oil lubricant, of a nominally active non-biodegradable sulfurized olefin derived from isobutylene.

2. The additive package of claim 1, wherein the at least one biodegradable sulfurized olefin comprises at least one of a minimally active biodegradable sulfurized olefin as measured under ASTM D1662 at 150° C, a nominally active biodegradable sulfurized olefin as measured under ASTM D1662 at 150° C, or mixtures thereof.

3. The additive package of claim 1, wherein the at least one sulfurized olefin that is readily or inherently biodegradable comprises at least one readily or inherently biodegradable sulfurized olefin derived from a natural source.

4. The additive package of claim 1, where the at least one biodegradable sulfurized olefin derived from a natural source comprises at least one biodegradable sulfurized olefin derived from rapeseed oil.

5. The additive package of claim 1, comprising further additive components.

6. An industrial gear oil lubricant comprising the additive package of claim 1 and a major amount of an oil of lubricating viscosity.

7. The industrial gear oil lubricant of claim 6, wherein the oil of lubricating viscosity comprises at least one of synthetic oils, vegetable oils, mineral oils, or mixtures thereof.

8. The industrial gear oil lubricant of claim 7, wherein the major amount of an oil of lubricating viscosity is biodegradable saturated synthetic oil.

9. A method of operating an industrial gear comprising applying to the gear an industrial gear oil as claimed in claim 6, and operating the gear.

* * * * *